US008205561B1

(12) United States Patent
Bierworth

(10) Patent No.: US 8,205,561 B1
(45) Date of Patent: Jun. 26, 2012

(54) READING OR WRITING TABLE ATTACHABLE TO WHEELCHAIRS

(75) Inventor: Rick Bierworth, Pascagonla, MS (US)

(73) Assignee: University of South Florida, Tampa, FL (US)

( * ) Notice: Subject to any disclaimer, the term of this patent is extended or adjusted under 35 U.S.C. 154(b) by 396 days.

(21) Appl. No.: 12/563,688

(22) Filed: Sep. 21, 2009

Related U.S. Application Data

(63) Continuation-in-part of application No. 10/707,008, filed on Nov. 13, 2003, now abandoned.

(51) Int. Cl.
*A47F 5/12* (2006.01)

(52) U.S. Cl. ..... 108/9; 108/157.11; 248/449; 248/456

(58) Field of Classification Search ..... 108/6, 9, 108/157.11; 248/449, 454–457
See application file for complete search history.

(56) References Cited

U.S. PATENT DOCUMENTS 2,328,471 A * 8/1943 Leffel ..... 108/6
4,364,699 A 12/1982 Koppes
4,403,786 A 9/1983 Ulics
4,566,732 A 1/1986 Ostergaard, II et al.
4,580,803 A 4/1986 Davis
4,659,099 A 4/1987 Malone
4,679,509 A 7/1987 Sampson, Jr.
4,705,287 A 11/1987 Cumbie
4,779,884 A 10/1988 Minati
4,795,182 A 1/1989 Dyess et al.
4,848,243 A * 7/1989 Giordano ..... 108/9
4,867,506 A 9/1989 Chavez
4,878,685 A 11/1989 Bahm
5,139,309 A 8/1992 Kornreich
5,228,711 A 7/1993 Summers
5,229,824 A 7/1993 Tsusaka et al.
5,294,027 A 3/1994 Plastina
5,356,059 A 10/1994 Yanez et al.
5,454,581 A 10/1995 Ringer
5,588,663 A 12/1996 Rundle et al.
5,896,817 A * 4/1999 Hancock ..... 108/50.01
D422,539 S 4/2000 Jacobson
6,302,032 B1 * 10/2001 Ranspach ..... 108/12

* cited by examiner

*Primary Examiner* — Hanh V Tran
(74) *Attorney, Agent, or Firm* — Nilay J. Choksi; Ronald E. Smith; Smith & Hopen, P.A.

(57) ABSTRACT

A frame includes a pair of parallel arms that are transversely spaced apart from one another. A first brace interconnects the parallel arms at their respective leading ends and a second brace interconnects the parallel arms at their respective mid-lengths. A table has a first end hingedly connected to the second brace. A first and second plurality of teeth is provided along an extent of the first and second arms, respectively. First and second support struts hingedly interconnect the table to preselected teeth when the table is in a first angular position relative to the frame. First and second book supports are slideably mounted on the table and lockable into any selected position. The parallel arms are releasably attached to the armrests of a conventional wheelchair. The support struts are disengaged from the teeth to enable folding the table into a horizontal storage position where it overlies the frame.

4 Claims, 4 Drawing Sheets

READING OR WRITING TABLE ATTACHABLE TO WHEELCHAIRS

CROSS-REFERENCE TO RELATED APPLICATIONS

This application is a continuation-in-part of nonprovisional application Ser. No. 10/707,008, filed Nov. 13, 2003, entitled Read/Write Tilting Table which claims priority to provisional application No. 60/319,691, filed Nov. 13, 2002, entitled Read/Write Tilting Table, both of which were filed by the same inventor.

BACKGROUND OF THE INVENTION

1. Field of the Invention

This invention relates, generally, to wheelchair attachments. More particularly, it relates to a table that is used for reading or writing and which is releasably attached to a wheelchair.

2. Description of the Prior Art

Many people in wheelchairs find it difficult to lean over a table to read, write, study, or for other purposes. School children in wheelchairs that use flat wheelchair tables are particularly affected. A conventional book holder can hold a book at an angle, but it is very awkward. Moreover, the writing surface remains level.

Conventional wheelchair tables can tilt about a center axis and are height adjustable. However, these tables require attachment hardware and cannot be installed on some wheelchairs, especially rigid frame wheelchairs.

There is therefore a need for a reading and writing table that is attachable to wheelchairs without hardware and that is easily adjustable into multiple usable angles of adjustment.

Prior art tables also require a user to look downward to be able to read and write, causing improper posture and neck pain.

Thus there is a need as well for a table that holds books or other papers at eye-level and that has means for preventing such books or papers from slipping.

However, in view of the prior art considered as a whole at the time the present invention was made, it was not obvious to those of ordinary skill in this art that how the identified needs could be fulfilled.

SUMMARY OF THE INVENTION

The long-standing but heretofore unfulfilled need for a table that is releasably attachable to a wheelchair, that is angularly adjustable, and that holds books and papers without slipping is now met by a new, useful, and non-obvious invention.

More particularly, the inventive structure includes a frame formed by a pair of longitudinally extending, parallel arms that are transversely spaced apart from one another. A first transversely disposed brace interconnects the pair of parallel arms at their respective leading ends and a second transversely disposed brace interconnects the pair of parallel arms at their respective mid-lengths.

A table, preferably formed of a transparent material, has a first end hingedly connected to the second transversely disposed brace.

A first plurality of teeth is provided along an extent of the first arm and a second plurality of teeth is provided along an extent of the second arm.

A first support strut has a first end hingedly interconnected to an underside of the table near a first side thereof and a second, distal end of the first support strut engages a selected tooth of the first plurality of teeth when the table is in a first angular position relative to the frame.

A second support strut has a first end hingedly interconnected to an underside of the table near a second side thereof and a second, distal end of the second support strut engages a selected tooth of the second plurality of teeth when the table is in the first angular position relative to the frame.

A first longitudinally extending slot is formed in the table near the first side thereof and a second longitudinally extending slot is formed in the table near the second side thereof in parallel, transversely spaced apart relation to the first longitudinally extending slot.

A first book-supporting device is slideably mounted within the first slot and a second book-supporting device is slideably mounted within the second slot. A first clamping means secures the first book-supporting device at any preselected position along an extent of the first slot and a second clamping means secures the second book-supporting device at any preselected position along an extent of the second slot. The first and second book-supporting devices have an "L"-shaped configuration so that a book supported by said devices does not slide therefrom when the table is positioned at an angle relative to the frame.

In a first embodiment, the first plurality of teeth is mounted to a top surface of the first arm and the second plurality of teeth is mounted to a top surface of the second arm.

In a second embodiment, a first longitudinally extending recess is formed in the first arm and the first plurality of teeth is formed in the first longitudinally extending recess. A second longitudinally extending recess is formed in the second arm and the second plurality of teeth is formed in the second longitudinally extending recess. Access openings formed at opposite ends of the first longitudinally extending recess are in open communication with a top surface of the first arm and access openings formed at opposite ends of the second longitudinally extending recess are in open communication with a top surface of the second arm.

The lower or distal end of the first and second support struts are respectively withdrawn from the first and second longitudinally extending recesses through the first access openings by rotating the table toward a user. The respective distal ends of the first and second support struts slide atop the top surface of the first and second arms as the table is rotated away from the user into a horizontal storage position.

The first and second access openings are selectively closed by first and second flexible flaps, respectively.

The primary object of this invention is to provide a book or paper-supporting table that is releasably attachable to a wheelchair.

Another object is to provide such a table that is angularly adjustable by a user.

Another object is to provide such a table that is attachable to wheelchairs in the absence of tools and hardware.

Another important object is to provide such a table that enables a user to read or write while looking straight ahead, avoiding postures that require the user to look down.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
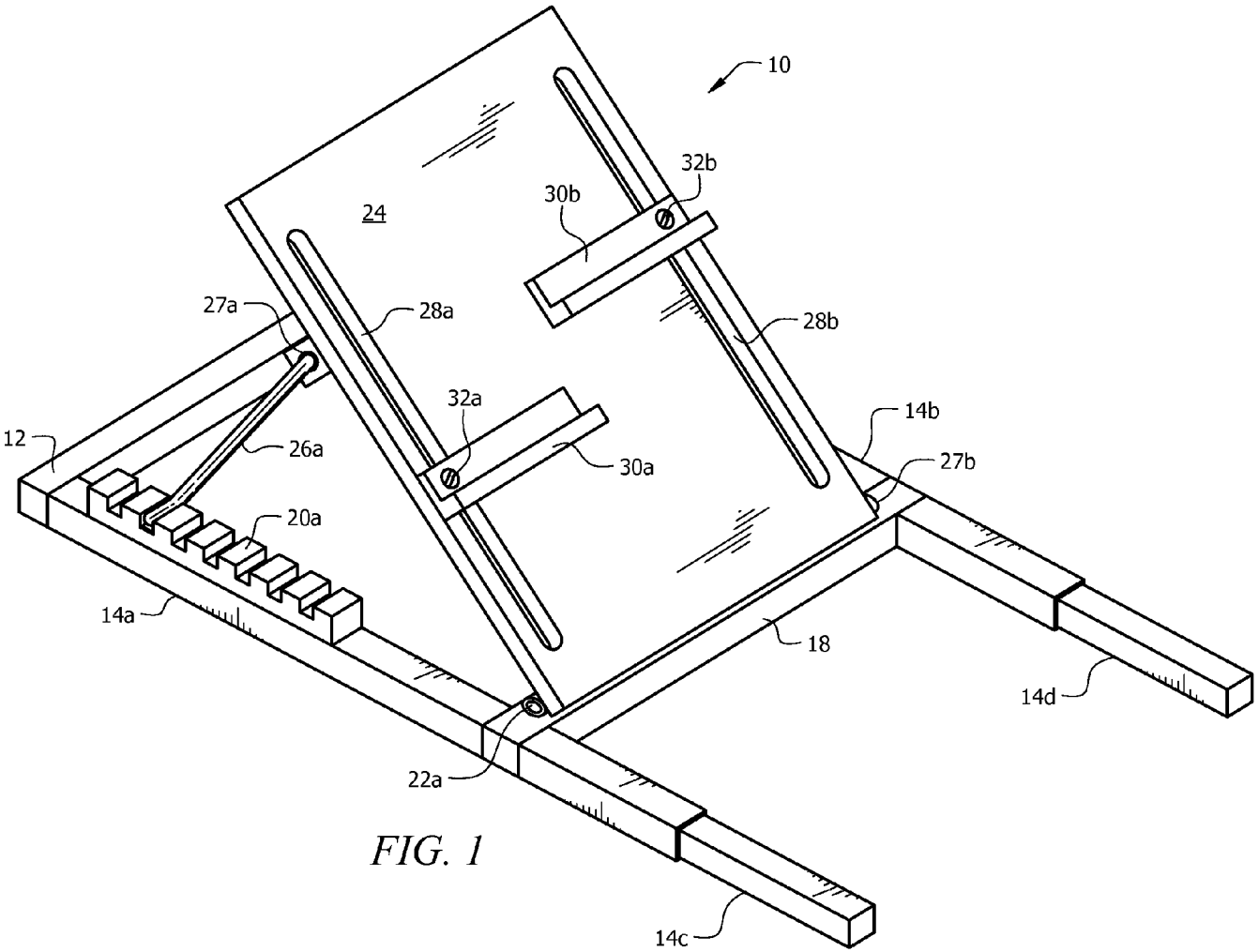
FIG. 1 is a perspective view of the novel structure.
Figure 2:
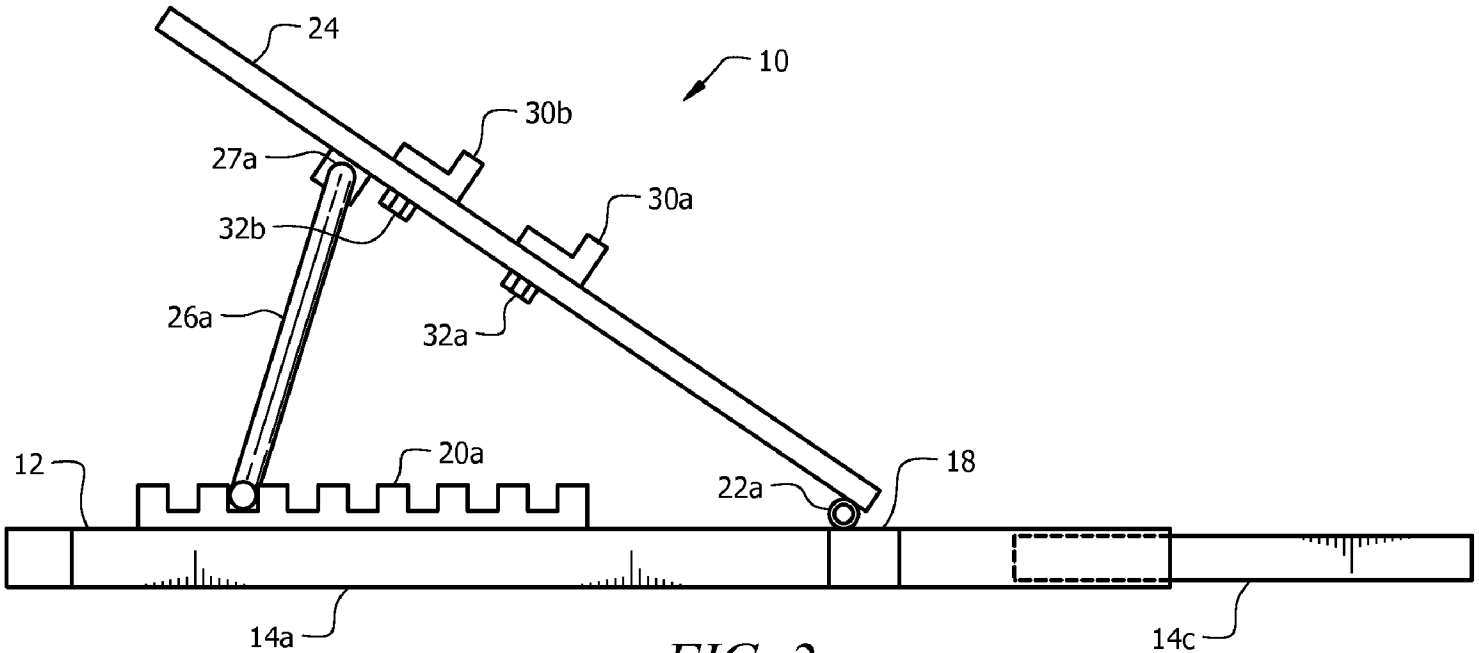
FIG. 2 is a side elevational view of the structure depicted in FIG. 1.
Figure 3:
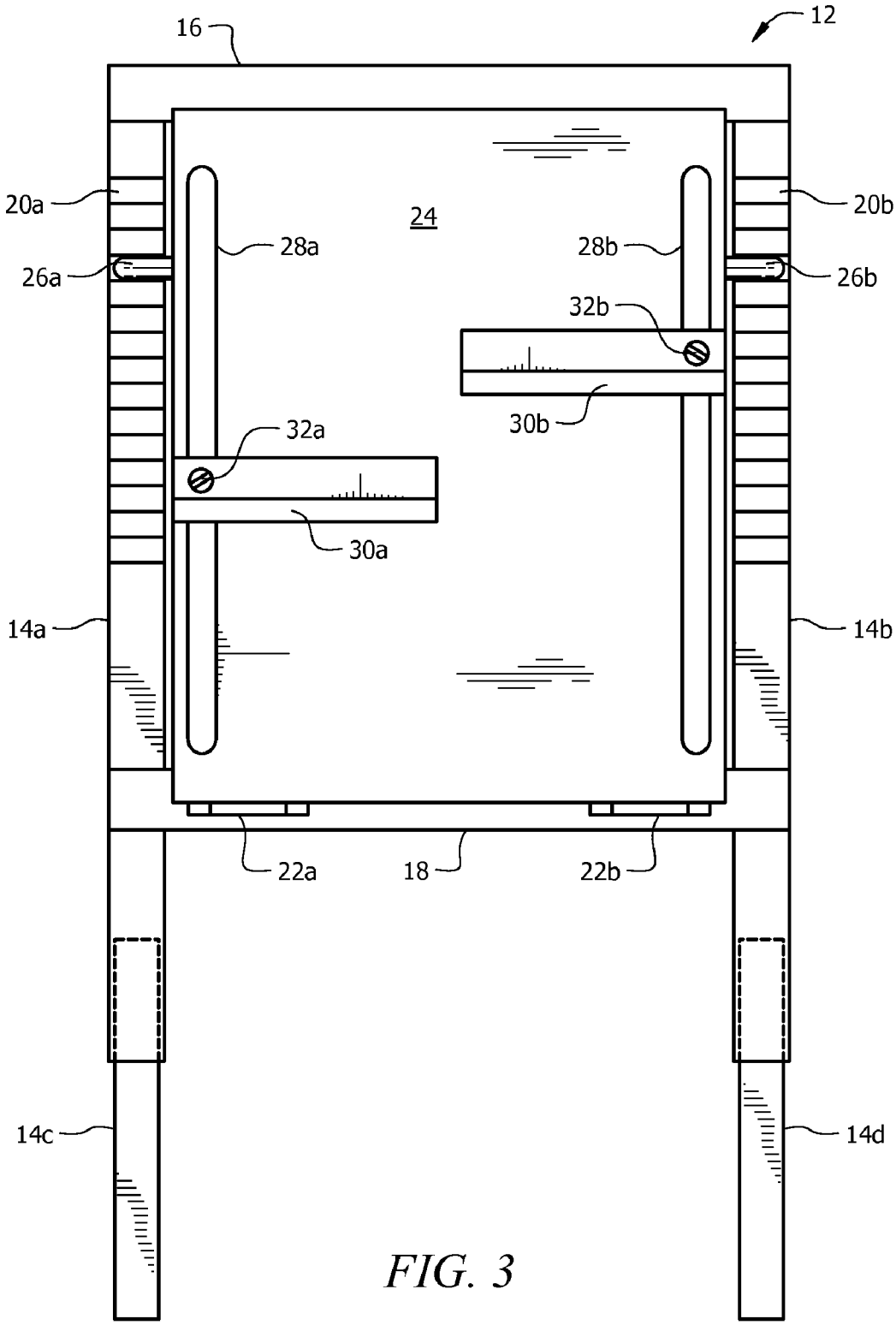
FIG. 3 is a top plan view of the novel structure when the tiltable table is lying flat, in a horizontal, storage position.

Referring now to FIGS. 1-3, it will there be seen that the novel table is denoted as a whole by the reference numeral 10.

Table assembly 10 includes frame 12. Frame 12 includes longitudinally disposed arms 14*a*, 14*b* that are transversely spaced apart from one another in parallel relation to one another. Arms 14*a*, 14*b* are interconnected to one another at their respective leading ends by first transverse brace 16 and are further interconnected to one another about mid-length thereof by second transverse brace 18.

As best understood in connection with FIG. 3, teeth 20*a* are secured to arm 14*a* and teeth 20*b* are secured to arm 14*b*.

Hinges 22*a* and 22*b* are secured to second transverse brace 18 although it is understood that one (1) elongate piano hinge could be provided in lieu of hinges 22*a*, 22*b*.

Arms 14*a*, 14*b* are hollow and light-in-weight, as are first and second braces 16 and 18.

The respective trailing ends of arms 14*a*, 14*b* telescopically receive extension arms 14*c*, 14*d* that slideably engage the existing horizontal armrests of a wheelchair, not depicted. Extension arms 14*c*, 14*d* enable a user to adjust the position of table assembly 10 in a horizontal plane.

If a wheelchair has hollow arms, extension arms 14*c*, 14*d* may be slideably inserted into the respective hollow interiors thereof. However, extension arms 14*c*, 14*d* are hollow so they may be slideably inserted over the respective existing arms of a wheelchair if the wheelchair design so permits. They are clamped atop the respective existing arms of the wheelchair if they cannot be slideably inserted into or over said existing arms. Any suitable clamping means, not depicted, may be used. Regardless of the attachment means employed, arms 14*a*, 14*b* are horizontally disposed when the wheelchair is supported on a horizontal support surface.

Table assembly 10 further includes book or paper support table 24, hingedly connected to second transverse brace 18 of frame 12 by hinges 22*a*, 22*b* and supported at various preselected angles by support struts 26*a*, 26*b* (leg 26*b* being obscured in FIGS. 1 and 2). Hinges 27*a*, 27*b* (27*b* being obscured by 27*a* in FIG. 2), interconnect the upper ends of said support struts to an underside of support table 24 as depicted in FIGS. 1 and 2. The lower or distal free ends of said support struts are selectively positioned along the extent of teeth 20*a*, 20*b* by the user to change the angle of support table 24 relative to a horizontal plane when the wheelchair is supported on a horizontal support surface. The distal end of each support strut has a ninety degree (90°) bend formed therein and such distal end selectively enters into the spaces between the teeth to hold the support struts from sliding as understood from an inspection of FIGS. 1 and 2. In FIG. 3, the support struts are substantially parallel to frame 12 and table 24 and are not engaging any teeth because table 24 is in its storage position.

Longitudinally-extending parallel slots 28*a*, 28*b* are formed in support table 24 near its opposite edges as depicted in FIGS. 1 and 3. "L"-shaped book or paper holders 30*a*, 30*b* are adjustable at any height along the extent of their respective slots 28*a*, 28*b* by any suitable clamping means 32*a*, 32*b*. Holders 30*a* and 30*b* are slideably mounted independently of one another so that a book and a paper, or two books or two papers, may be held at differing heights. Clamping means 32*a*, 32*b* preferably include large, ergonomic hand grips so that a user may reach under table 24 without looking and loosen and tighten such clamps without tools so that holders 30*a*, 30*b* may be quickly positioned at any height along the extent of their respective slots 28*a*, 28*b*.

Support table 24 is preferably transparent so that a student in a class, for example, may see and be seen by a teacher when table 24 is raised into a position sufficient to create a barrier.

In a second embodiment, as depicted in FIGS. 4A-D, a longitudinally-extending recess is formed in each arm 14*a*, 14*b* and teeth 20*a*, 20*b* are formed with their respective recesses. Said FIGS. 4A-D provide an animation of support strut movement.

Figure 4A:
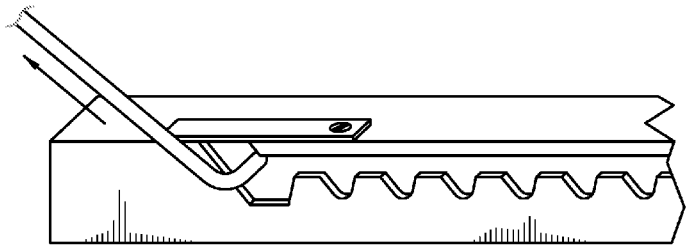
FIG. 4A is a first perspective view of a four series animation depicting the operation of an alternative embodiment of one set of the adjustment teeth and its associated support arm.

In FIG. 4A, support strut 26*a* is in a retracted position where it is not in engagement with any teeth and said support strut is disposed at a steep angle because table 24 is almost perpendicular to frame 14. Flexible flap 34*a* covers a first access entrance to the recess within which is formed teeth 20*a*.

Figure 4B:
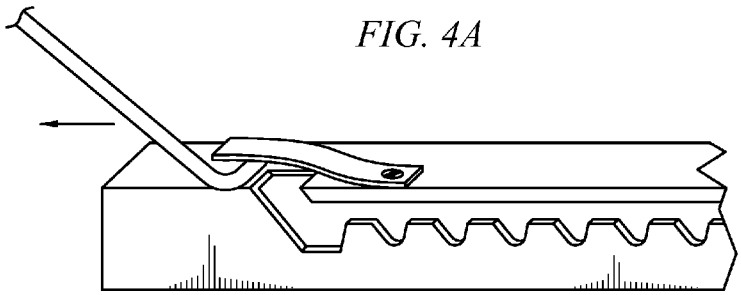
FIG. 4B is a second perspective view of said animation.

Flap 34*a* is momentarily displaced as depicted in FIG. 4B when a user positions table 24 in a perpendicular or nearly perpendicular relation to frame 14 to thereby cause complete retraction of support arm 26*a* from the recess formed in frame 14*a*.

The user rotates table 24 about hinges 22*a*, 22*b* so that the top of table 24 approaches the user when support arm 26*a* is displaced from its FIG. 4A to its FIG. 4B position.

Figure 4C:
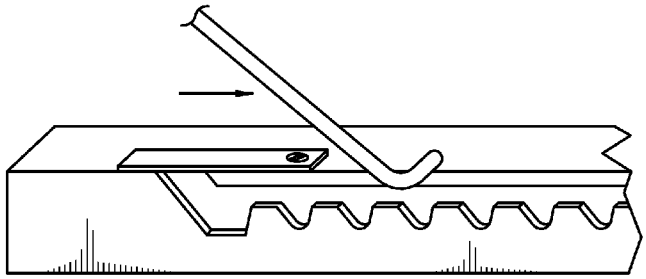
FIG. 4C is a third perspective view of said animation.
Figure 4D:
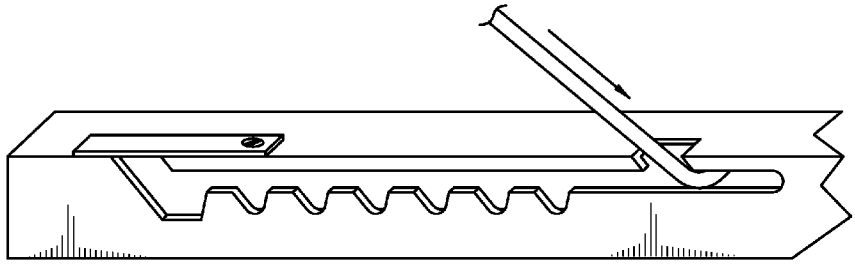
FIG. 4D is a fourth perspective view of said animation.

Flap 34*a* returns under its inherent bias to its position of repose as depicted in FIG. 4C when the user begins to lower table 24 into its storage position. Support strut 26*a* slides unimpeded along the extent of frame 14*a* as the user rotates table 24 about hinges 22*a*, 22*b* so that the top of table 24 is moving away from the user. This cannot be done in the embodiment of FIGS. 1-3 because the teeth are not recessed in that embodiment.

As table 24 approaches its horizontal, storage position, the distal free end of support strut 26*a* enters into a second access opening, denoted 27*a*. A similar access opening 27*b*, not depicted, is provided in arm 14*b* for the simultaneous reception of the distal end of support strut 26*b* as said table 24 is lowered. Entry of said distal end into said second access opening 27*a* enables support struts 26*a*, 26*b* to enter into an almost horizontal plane so that table 24 can be fully lowered when not in use.

When the user desires to raise table 24 into a raised position, table 24 is rotated about hinges 22*a*, 22*b* so that the top edge of table 24 approaches the user; the distal end of each support strut will not exit second access openings 27*a*, 27*b*, but will instead slide in sequence over each tooth is the respective sets of teeth 20*a*, 20*b*. The teeth are swept back toward the user to enable such sliding. When the desired angle is found, the user releases table 24 and the support struts enter into and stay in a space between teeth when the table is released due to the forward sweep of the teeth which prevents sliding of the teeth away from the user.

To lower the table, the user rotates table 24 so that its top edge approaches the user so that the displacements disclosed above in connection with FIGS. 4A and 4B are repeated.

This embodiment thus represents a substantial improvement over the first embodiment because the user does not need to hold support struts 26*a*, 26*b* out of engagement with their respective teeth when raising and lowering table 24.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

What is claimed is:

1. An apparatus, comprising:

a frame;

said frame including a pair of longitudinally extending, parallel arms that are transversely spaced apart from one another;

a first transversely disposed brace for interconnecting said pair of parallel arms at respective leading ends of said parallel arms;

a second transversely disposed brace for interconnecting said pair of parallel arms at respective mid-lengths of said parallel arms;

a table having a first end hingedly connected to said second transversely disposed brace;

a first plurality of teeth provided along an extent of a first arm of said pair of parallel arms;

a second plurality of teeth provided along an extent of a second arm of said pair of parallel arms;

a first support strut having a first end hingedly interconnected to said table and a second end of said first support strut engaged by a selected tooth of said first plurality of teeth when said table is in a first angular position relative to said frame;

a second support strut having a first end hingedly interconnected to said table and a second end of said second support strut engaged by a selected tooth of said second plurality of teeth when said table is in said first angular position relative to said frame;

a first longitudinally extending slot formed in said table;

a second longitudinally extending slot formed in said table in spaced apart, parallel relation to said first longitudinally extending slot;

a first book-supporting device slideably mounted within said first slot;

a second book-supporting device slideably mounted within said second slot;

a first clamping means for securing said first book-supporting device at any preselected position along an extent of said first slot;

a second clamping means for securing said second book-supporting device at any preselected position along an extent of said second slot;

a first longitudinally extending recess formed in said first arm;

said first plurality of teeth formed in said first longitudinally extending recess;

a second longitudinally extending recess formed in said second arm;

said second plurality of teeth formed in said second longitudinally extending recess;

a first access opening formed in a top surface of said first arm at a first end of said recess formed in said first arm and a second access opening formed in a top surface of said first arm at a second end of said recess; and a first access opening formed in a top surface of said second arm at a first end of said recess formed in said second arm and a second access opening formed in a top surface of said second arm at a second end of said recess;

whereby respective second ends of said first and second support struts are withdrawn from said first and second longitudinally extending recesses through said respective first access openings by rotating said table toward a user;

whereby respective second ends of said first and second support struts slide atop said respective top surfaces of said first and second arms when said table is rotated away from said user into a horizontal storage position.

2. The apparatus of claim 1, further comprising:

said first book-supporting device having an "L"-shaped configuration so that a book supported by it does not slide therefrom when said table is positioned at an angle relative to said frame;

said second book-supporting device having an "L"-shaped configuration so that a book supported by it does not slide therefrom when said table is positioned at an angle relative to said frame.

3. The apparatus of claim 1, further comprising:

said table being formed of a transparent material.

4. The apparatus of claim 1, further comprising:

said respective first access openings being selectively closed by flexible flaps.

* * * * *